US010227833B2

(12) United States Patent
Boddeda

(10) Patent No.: US 10,227,833 B2
(45) Date of Patent: Mar. 12, 2019

(54) CENTRALIZER FOR EXPANDABLE LINER

(71) Applicant: ENVENTURE GLOBAL TECHNOLOGY, LLC, Houston, TX (US)

(72) Inventor: Nanda Boddeda, Houston, TX (US)

(73) Assignee: Enventure Global Technology, Inc., Houston, TX (US)

( * ) Notice: Subject to any disclaimer, the term of this patent is extended or adjusted under 35 U.S.C. 154(b) by 939 days.

(21) Appl. No.: 14/531,594

(22) Filed: Nov. 3, 2014

(65) Prior Publication Data

US 2015/0122508 A1 May 7, 2015

Related U.S. Application Data

(60) Provisional application No. 61/899,997, filed on Nov. 5, 2013.

(51) Int. Cl.

| | |
|---|---|
| ***E21B 17/10*** | (2006.01) |
| ***E21B 19/24*** | (2006.01) |
| ***E21B 17/00*** | (2006.01) |
| *E21B 43/10* | (2006.01) |

(52) U.S. Cl.

CPC ..... *E21B 17/1028* (2013.01); *E21B 17/00* (2013.01); *E21B 19/24* (2013.01); *E21B 43/105* (2013.01)

(58) Field of Classification Search

CPC .... E21B 17/1028; E21B 17/10; E21B 43/105; E21B 19/24

See application file for complete search history.

(56) References Cited

U.S. PATENT DOCUMENTS

| | | | | |
|---|---|---|---|---|
| 5,560,426 | A * | 10/1996 | Trahan | E21B 23/01 166/120 |
| 2005/0189103 | A1* | 9/2005 | Roberts | E21B 33/1204 166/134 |
| 2006/0090902 | A1* | 5/2006 | Costa | E21B 17/042 166/380 |
| 2006/0115335 | A1* | 6/2006 | Allen | E21B 17/01 405/274 |
| 2008/0283253 | A1* | 11/2008 | Buytaert | E21B 17/1028 166/381 |
| 2013/0248206 | A1* | 9/2013 | Jordan | E21B 19/24 166/381 |

FOREIGN PATENT DOCUMENTS

| | | |
|---|---|---|
| WO | 2008144249 | 11/2008 |
| WO | 2013135297 | 9/2013 |

OTHER PUBLICATIONS

Search Report and Written Opinion dated May 4, 2015 for International Application No. PCT/US2014/063700 (83 pgs.).

* cited by examiner

*Primary Examiner* — Waseem Moorad
*Assistant Examiner* — Christopher J Sebesta
(74) *Attorney, Agent, or Firm* — Jonathan M. Pierce; Porter Hedges LLP

(57) ABSTRACT

A centralizer comprises a plurality of bow springs, wherein each bow spring has a first and second end. A first collar is coupled to the first end of each of the plurality of bow springs and includes a longitudinal frangible region. A second collar is coupled to the second end of each of the plurality of bow springs and also includes a longitudinal frangible region.

7 Claims, 3 Drawing Sheets

CENTRALIZER FOR EXPANDABLE LINER

CROSS-REFERENCE TO RELATED APPLICATIONS

This application claims the benefit under 35 U.S.C. § 119(e) of U.S. Provisional Patent Application No. 61/899,997 filed Nov. 5, 2013, the disclosure of said applications is hereby incorporated herein by reference.

BACKGROUND

This disclosure relates generally to methods and apparatus for centralizing an expandable tubular member within a wellbore. More specifically, this disclosure relates to methods and apparatus for centralizing an expandable tubular member within a wellbore with a centralizer that includes collars with a frangible region.

Centralizers are used to maintain a radial stand-off between a wellbore tubular, such as a casing, and the interior wall of the wellbore in which the tubular is being installed. Maintaining this radial stand-off can help to reduce the likelihood of the wellbore tubular becoming stuck during running and provides a suitable annulus for cementing the tubular into the wellbore.

One type of centralizer is a bow spring centralizer that utilizes a plurality of flexible bow springs distributed around the circumference of the wellbore tubular. Bow spring centralizers generally include a pair of axially-spaced collars that surround the wellbore tubular and are coupled together by the plurality of bow springs. The bow springs are arranged to bow radially outwardly from the axis of the wellbore tubular so as to engage the wall of the wellbore. Thus, the bow springs provide stand-off from the wall of the wellbore and can flex, or collapse, inwardly in order to accommodate restrictions in the wellbore.

Expandable tubular are used in certain applications where wellbore restrictions may limit the diameter of a tubular that can be used. Expandable tubulars are run into the wellbore and then radially expanded to a larger diameter by any number of processes. Conventional centralizers are likely to interfere with, or be damaged during, the expansion process and often are not used with expandable tubular systems.

Thus, there is a continuing need in the art for methods and apparatus for centralizing expandable tubulars.

BRIEF SUMMARY OF THE DISCLOSURE

A centralizer comprises a plurality of bow springs, wherein each bow spring has a first and second end. A first collar is coupled to the first end of each of the plurality of bow springs and includes a longitudinal frangible region. A second collar is coupled to the second end of each of the plurality of bow springs and also includes a longitudinal frangible region.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
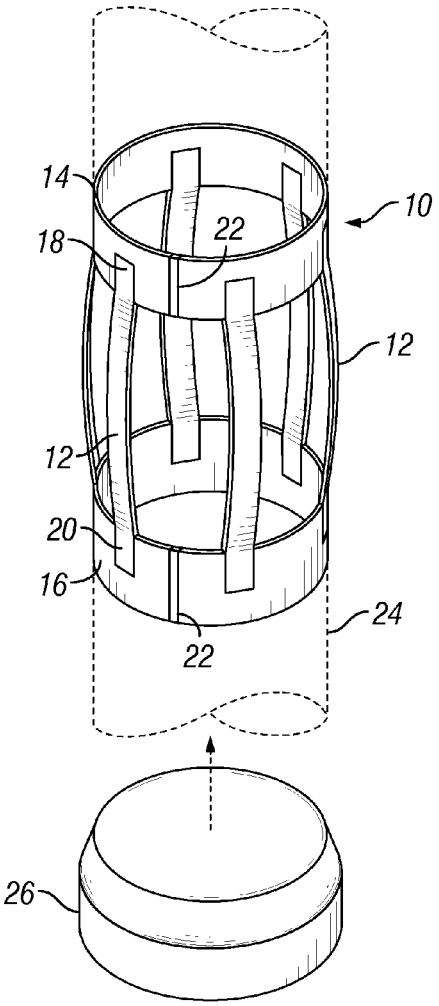
FIG. 1 is a perspective view of an unexpanded bow spring centralizer having collars with a longitudinal frangible region.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a centralizer 10 includes a plurality of bow springs 12, a first collar 14, and a second collar 16. Each bow spring 12 has a first end 18 that is coupled to the first collar 14 and a second end 20 that is coupled to the second collar 16. The bow springs 12 may be coupled to the first collar 14 and the second collar 16 by welding, brazing, mechanical fasteners, or any other coupling means. The bow springs 12 may be substantially uniformly spaced around the circumference of, and so as to bow radially outward from, the first collar 14 and the second collar 16. Each of the first collar 14 and the second collar 16 include a longitudinal frangible region 22

The centralizer 10 is coupled to an outer surface of an expandable tubular member 24 before the tubular member is run into a wellbore. The centralizer 10 may be coupled to the expandable tubular member 24 directly or may be axially constrained on the expandable tubular member 24 by one or more stop collars (not shown) that are coupled to the expandable tubular member 24 on at least one side of the centralizer 10. The stop collars may be coupled to the expandable tubular member 24 by set screws, brazing, or by other means. Each stop collar may also include a frangible region similar to the frangible regions 22 on the centralizer 10.

Once positioned in a wellbore, the expandable tubular member 24 is radially expanded. An expansion mandrel 26 may be disposed within the expandable tubular member 24 so that longitudinal translation of the expansion mandrel 26 through the expandable tubular member 24 radially expands the expandable tubular member 24. In other embodiments, the expandable tubular member 24 may be radially expanded by other methods.

Figure 2:
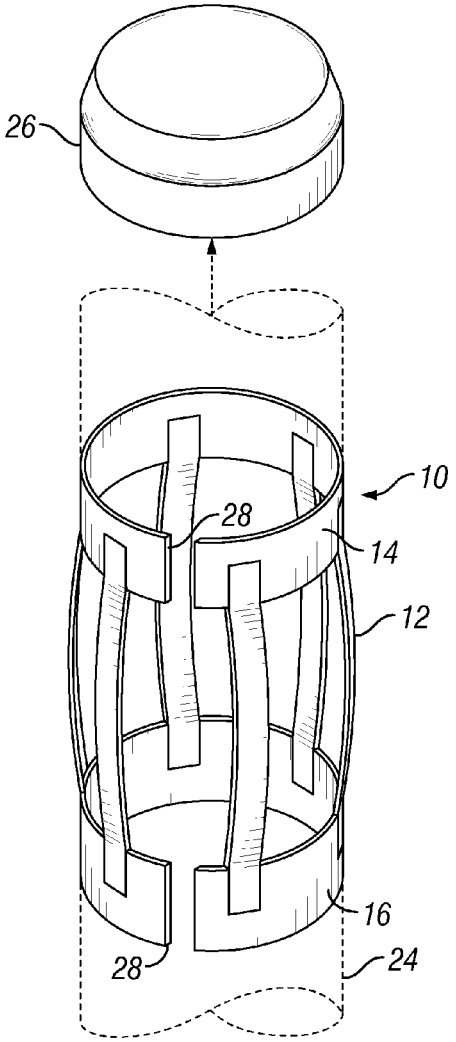
FIG. 2 is a perspective view of an unexpanded bow spring centralizer having collars with a longitudinal frangible region.

Referring now to FIG. 2, as the expandable tubular member 24 is radially expanded the first collar 14 and second collar 16 will also radially expand. As the first collar 14 and the second collar 16 radially expand, their respective longitudinal frangible regions 22 will break and create a separated region 28 in both the first collar 14 and the second collar 16. In certain embodiments, the longitudinal frangible region 22 may not break but may allow the first collar 14 or the second collar 16 to stretch to accommodate the expansion of the expandable tubular member 24.

The separated region 28 allows the first collar 14 and the second collar 16 to radially expand with the expandable tubular member 24. The longitudinal frangible regions 22 is designed to reduce the excess expansion forces needed to pass the expansion mandrel 26 through the portion of the expandable tubular member 24 fitted with the centralizer 10 and to ensure that the first collar 14 and the second collar 16 break at a predictable location. In certain embodiments, the expansion force needed to expand the expandable tubular member 24 and the centralizer 10 may be limited to a 10-15% increase over the expansion force needed to expand just the expandable tubular member 24. Without the longitudinal frangible region 22, the first collar 14 and second collar 16 may tend to break at or near the connection of a bow spring 12, which may cause a bow spring 12 to become misaligned and therefore degrade the performance of the centralizer 10.

FIGS. 3-7 illustrate various alternative longitudinal frangible regions 22 that may be used with a centralizer 10. The illustrated embodiments are not meant to be limiting and a wide variety of features may be used to form a suitable longitudinal frangible region 22.

Figure 3:
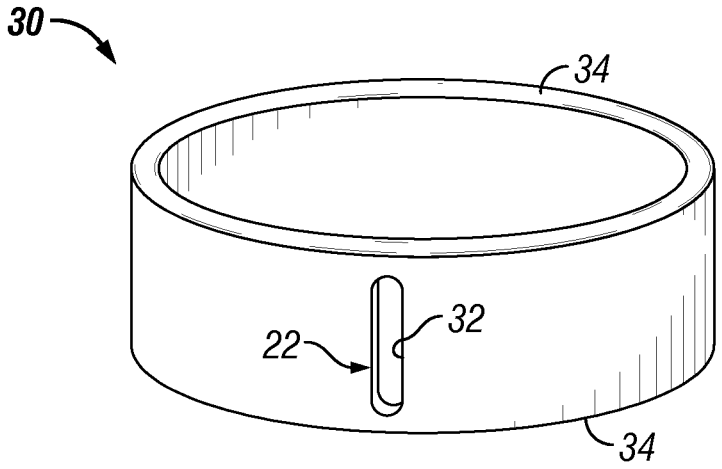
FIG. 3 is a perspective view of a centralizer collar having a slot.

FIG. 3 illustrates a collar 30 having a longitudinal frangible region 22 formed by a slot 32. The slot 32 does not extend to the faces 34 of the collar 30. The slot 32 is illustrated as extending through the entire thickness of the collar 30 but in certain embodiments it may not penetrate the wall of the collar 30. The slot 32 is also illustrated as an oval slot but may have any other desirable shape.

Figure 4:
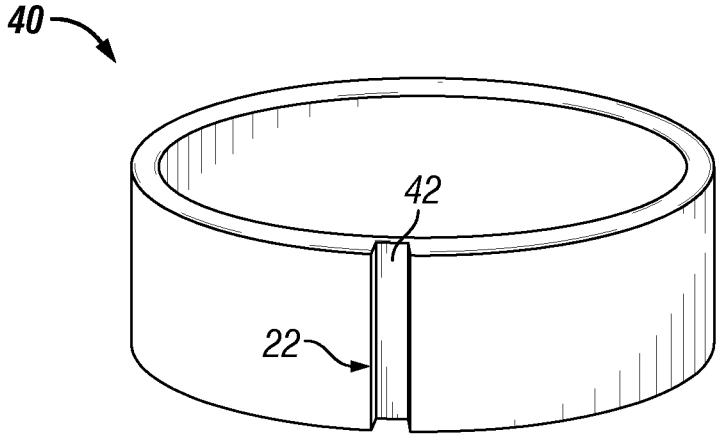
FIG. 4 is a perspective view of a centralizer collar having a groove.

FIG. 4 illustrates a collar 40 having a longitudinal frangible region 22 formed by a groove 42. The groove 42 may be formed on the internal or external surface of the collar 40 and may extend either over a portion of, or the entire, width of the collar 40. The groove 42 is shown with a rectangular cross-section but may have any other desirable shape.

Figure 5:
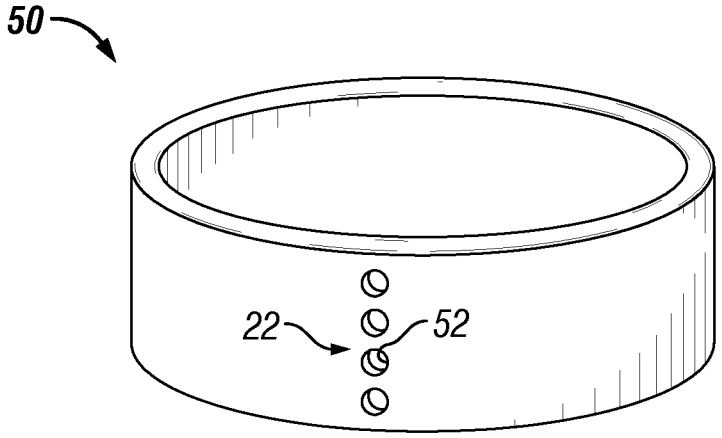
FIG. 5 is a perspective view of a centralizer collar having perforations.

FIG. 5 illustrates a collar 50 having a longitudinal frangible region 22 formed by perforations 52. The perforations 52 may have any shape and may or may not extend through the entire thickness of the collar 50.

Figure 6:
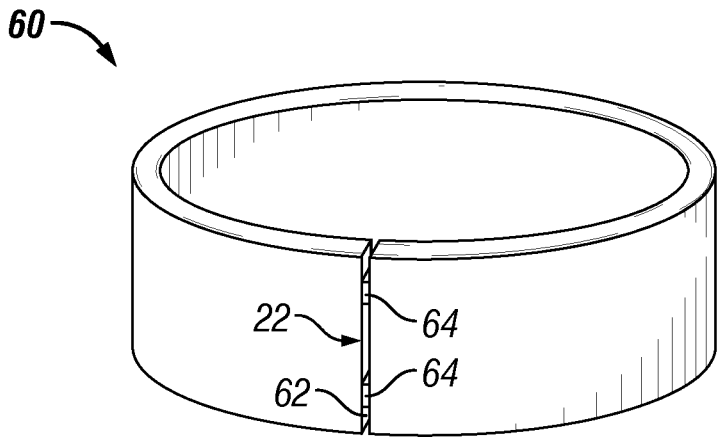
FIG. 6 is a perspective view of a centralizer collar having a tack weld.

FIG. 6 illustrates a collar 60 having a longitudinal frangible region 22 formed by a split 62 in the collar 60 that is held together by spot welds 64. In certain embodiments, the split 62 may be held together by a continuous weld designed to have a lower strength than the collar 60.

Figure 7:
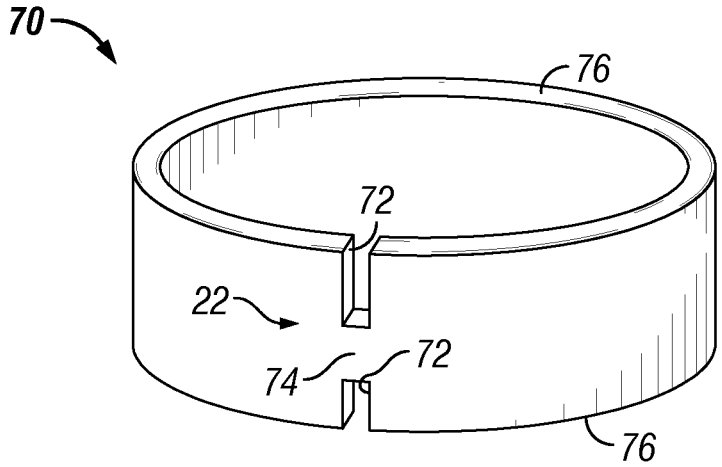
FIG. 7 is a perspective view of a centralizer collar having notches.

FIG. 7 illustrates a collar 70 having a longitudinal frangible region 22 formed by a longitudinal notch 72 that forms a reduced width wall portion 74. In certain embodiments, a longitudinal notch 72 may extend from both faces 76 of the collar 70. The longitudinal notch 72 may extend partially or completely through the collar 70.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A method for centralizing an expandable tubular member comprising:

fabricating first and second continuous collars, wherein each continuous collar is surrounding an entire circumference of the expandable tubular member and has only one longitudinal frangible region;

coupling a plurality of bow springs to the first and second continuous collars to form a centralizer wherein the plurality of bow springs bow radially outward from the first and second continuous collars, wherein terminal ends of each of the plurality of bow springs are directly coupled to the first and second continuous collars;

disposing the centralizer on an expandable tubular member; and radially expanding the expandable tubular member so as to break the first and second continuous collars at their respective longitudinal frangible regions to form a separated region in both the first and second continuous collars so that the first and second continuous collars in their entirety are no longer surrounding the entire circumference of the expandable tubular member.

2. The method of claim 1, further comprising coupling the first or second continuous collar to the expandable tubular member.

3. The method of claim 1, wherein at least one of the longitudinal frangible regions comprises a slot.

4. The method of claim 1, wherein at least one of the longitudinal frangible regions comprises a groove.

5. The method of claim 1, wherein at least one of the longitudinal frangible regions comprises perforations.

6. The method of claim 1, wherein at least one of the longitudinal frangible regions comprises a tack weld.

7. The method of claim 1, wherein at least one of the longitudinal frangible regions comprises a longitudinal notch.

* * * * *